US010174577B2

(12) United States Patent
Leuchtenberg et al.

(10) Patent No.: US 10,174,577 B2
(45) Date of Patent: Jan. 8, 2019

(54) SEALING ELEMENT WEAR INDICATOR SYSTEM

(71) Applicant: MANAGED PRESSURE OPERATIONS PTE. LTD., Singapore (SG)

(72) Inventors: Christian Leuchtenberg, Singapore (SG); Austin Johnson, Houston, TX (US); Patrick David Savage, Queensland (AU)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 203 days.

(21) Appl. No.: 15/113,438

(22) PCT Filed: Jan. 21, 2015

(86) PCT No.: PCT/EP2015/051154
§ 371 (c)(1),
(2) Date: Jul. 22, 2016

(87) PCT Pub. No.: WO2015/110478
PCT Pub. Date: Jul. 30, 2015

(65) Prior Publication Data

US 2017/0009550 A1 Jan. 12, 2017

(30) Foreign Application Priority Data

Jan. 24, 2014 (GB) ..... 1401223.1

(51) Int. Cl.
*E21B 33/08* (2006.01)
*E21B 47/01* (2012.01)
*E21B 3/00* (2006.01)
*E21B 21/08* (2006.01)

(52) U.S. Cl.
CPC ..... *E21B 33/085* (2013.01); *E21B 3/00* (2013.01); *E21B 21/08* (2013.01); *E21B 47/01* (2013.01)

(58) Field of Classification Search
CPC ..... E21B 33/085; E21B 47/01; E21B 21/08; E21B 3/00
See application file for complete search history.

(56) References Cited

U.S. PATENT DOCUMENTS 4,922,423 A 5/1990 Koomey et al.
6,129,152 A 10/2000 Hosie et al.
7,699,109 B2 4/2010 May et al.
7,926,560 B2 4/2011 Bailey et al.
(Continued)

FOREIGN PATENT DOCUMENTS

CA 2893128 A1 * 7/2014 ..... E21B 47/00
WO WO 2011/128690 A1 10/2011
(Continued)

*Primary Examiner* — Yong-Suk Ro
(74) *Attorney, Agent, or Firm* — Norman B. Thot

(57) ABSTRACT

A seal assembly for use in a pressure containment device for containing a fluid pressure in an annular space around a drill string while allowing the drill string to rotate in the pressure containment device. The seal assembly includes a seal comprising and an inner surface and a tubular body, and a wear sensor embedded in the tubular body. The wear sensor emits an alert signal when the inner surface of the seal has been worn away by a preset amount.

19 Claims, 15 Drawing Sheets

(56) References Cited

U.S. PATENT DOCUMENTS

| | | | | |
|---|---|---|---|---|
| 2008/0296016 | A1 | 12/2008 | Hughes et al. | |
| 2011/0036560 | A1* | 2/2011 | Vail, III | E21B 28/00 166/87.1 |
| 2013/0168578 | A1 | 7/2013 | Leuchtenberg et al. | |
| 2014/0284103 | A1* | 9/2014 | Niina | E21B 47/00 175/24 |
| 2015/0159460 | A1* | 6/2015 | Boyd | E21B 33/085 166/86.1 |
| 2016/0273333 | A1 | 9/2016 | Pool et al. | |

FOREIGN PATENT DOCUMENTS

| | | | |
|---|---|---|---|
| WO | WO 2012/127227 | A2 | 9/2012 |
| WO | WO 2015/060836 | A1 | 4/2015 |

* cited by examiner

SEALING ELEMENT WEAR INDICATOR SYSTEM

CROSS REFERENCE TO PRIOR APPLICATIONS

This application is a U.S. National Phase application under 35 U.S.C. § 371 of International Application No. PCT/EP2015/051154, filed on Jan. 21, 2015 and which claims benefit to Great Britain Patent Application No. 1401223.1, filed on Jan. 24, 2014. The International Application was published in English on Jul. 30, 2015 as WO 2015/110478 A2 under PCT Article 21(2).

FIELD

The present invention relates to a sealing element wear indicator system, particularly, but not exclusively for use in an oil/gas drilling system.

BACKGROUND

Subterranean drilling typically involves rotating a drill bit from surface or on a downhole motor at the remote end of a tubular drill string. It involves pumping a fluid down the inside of the tubular drill string, through the drill bit, and circulating this fluid continuously back to surface via the drilled space between the hole/tubular, referred to as the annulus. For a subsea well bore, a tubular, known as a riser extends from the rig to the top of the wellbore which exists at subsea level on the ocean floor. It provides a continuous pathway for the drill string and the fluids emanating from the well bore. In effect, the riser extends the wellbore from the sea bed to the rig, and the annulus also comprises the annular space between the outer diameter of the drill string and the riser.

This pumping mechanism is provided by positive displacement pumps that are connected to a manifold which connects to the drill string, and the rate of flow into the drill string depends on the speed of these pumps. The drill string is comprised of sections of tubular joints connected end to end, and their respective outside diameter depends on the geometry of the hole being drilled and their effect on the fluid hydraulics in the wellbore.

The entire drill string and bit are rotated using a rotary table, or using an above ground motor mounted on the top of the drill pipe known as a top drive. The bit can also be turned independently of the drill string by a drilling fluid powered downhole motor, integrated into the drill string just above the bit.

As drilling progresses pipe has to be connected to the existing drill string to drill deeper. Conventionally, this involves shutting down fluid circulation completely so the pipe can be connected into place as the top drive has to be disengaged.

The large diameter sections that exist at the end of each section of drillpipe are referred to as tool joints. During a connection, these areas provide a low stress area where the rig pipe tongs or Iron Roughneck can be placed to grip the pipe and apply torque to either make or break a connection.

Conventionally, the well bore is open to atmospheric pressure and there is no surface applied pressure or other pressure existing in the system. The drill string rotates freely without any sealing elements imposed or acting on the drill string at the surface, and there is no requirement to divert the return fluid flow or exert pressure on the system during these standard operations.

Managed pressure drilling and/or underbalanced drilling utilizes additional special equipment that has been developed to keep the well closed at all times, as the wellhead pressures in these cases are non-atmospheric, as in the traditional art of the conventional overbalanced drilling method.

The invention is particularly useful in an operating system with a well having a drilling fluid circulating within a closed loop system. The closed loop is generated by a seal around the drill pipe at surface using a pressure containment device, diverting all returned flow to a flow line. These are referred to as a rotating control head (RCD or RCH), pressure control while drilling (PCWD) or rotating blow out preventer (RBOP). The function of the rotating pressure containment device is to allow the drill string and its tool joints to pass through with reciprocation/stripping or rotation. With drilling activity in progress and the device closed a back pressure is created on the annulus. The drill string is stripped or rotated through the sealing element(s) pressure containment device which isolates the pressurized annulus from the external atmosphere while maintaining a pressure seal around the drill pipe. All are standard equipment that are commercially available or readily adaptable from existing designs on the market and are well known in the art.

A typical sealing element in existing pressure containment designs includes an elastomer or rubber packing/sealing element and a bearing assembly that allows the sealing element to rotate along with the drill string. There is no rotational movement between the drill string and the sealing element, and only the bearing assembly exhibits the rotational movement during drilling. These are well known in the art and are described in detail in Patents U.S. Pat. No. 7,699,109B2, U.S. Pat. No. 7,926,560, and U.S. Pat. No. 6,129,152.

An alternative pressure containment device is disclosed in WO2011128690 and WO2012127227. This device includes a combined non-elastomeric and elastomeric sealing element, referred to as the seal sleeve, which does not rotate with the drill string, i.e., it remains stationary while the drill string is rotated and reciprocated within the sealing face.

Drill string rotation and vertical movement wears out the sealing elements, and the passage of tool joints and larger OD tubulars causes the sealing element to expand and contract multiple times. Replacement requires the drilling operation to stop and therefore lowers the well performance, and the replacement frequency for sealing assemblies varies with wellbore pressure, temperature, fluid composition, and stripping/rotating frequency over the drilling and tripping phases. Therefore a wear monitoring system for the sealing elements will allow the wear rate to be examined over these varied conditions as the element degrades and reduces in thickness, indicating when the sealing element should be replaced. This results in a much safer and efficient operation on the drilling platform.

Additionally, there are hazards and risks associated with uncertainty in the degree of wear of the sealing element(s) in the housing. There are no indications that the sealing element is failing, and generally they leak when they fail while in operation. A consequential uncontrolled pressure release occurs, carrying with it drilling fluids, cuttings, and possibly gas into the working atmosphere of the rig. This poses both environmental and workplace hazards to personnel and equipment that could be eliminated if a wear monitoring system was in place.

Typically, a dual sealing arrangement for an RCD monitors the pressure between the two sealing elements. A pressure differential exists between the cavity of the sealing elements and the wellbore pressure below. It is known to monitor continuously the pressure between the elements, and when the pressure starts to increase, take this as a positive indicator that the lower sealing element is failing.

This method is not suitable for accurately monitoring the wear of the upper sealing element, however. Furthermore, there are no systems or methods for monitoring the wear occurring on the inner bore sealing area, nor the thickness of the sealing material remaining within a single element arrangement in the prior art. Detection is solely through visual leak paths through the sealing elements that will result in pressure releases to the atmosphere.

SUMMARY

An aspect of the present invention is to provide a sealing element that includes a system to monitor and/or detect the wear rate of the elements in place as a preventative measure for failure and resultant pressure/fluid/gas release. This will allow a proactive method for the safe replacement of the sealing element(s) before they reach total failure.

In an embodiment, the present invention provides a seal assembly for use in a pressure containment device for containing a fluid pressure in an annular space around a drill string whilst allowing the drill string to rotate in the pressure containment device. The seal assembly includes a seal comprising and an inner surface and a tubular body, and a wear sensor embedded in the tubular body. The wear sensor is configured to emit an alert signal when the inner surface of the seal has been worn away by a preset amount.

BRIEF DESCRIPTION OF THE DRAWINGS

The present invention is described in greater detail below on the basis of embodiments and of the drawings in which.

DETAILED DESCRIPTION

Figure 2:
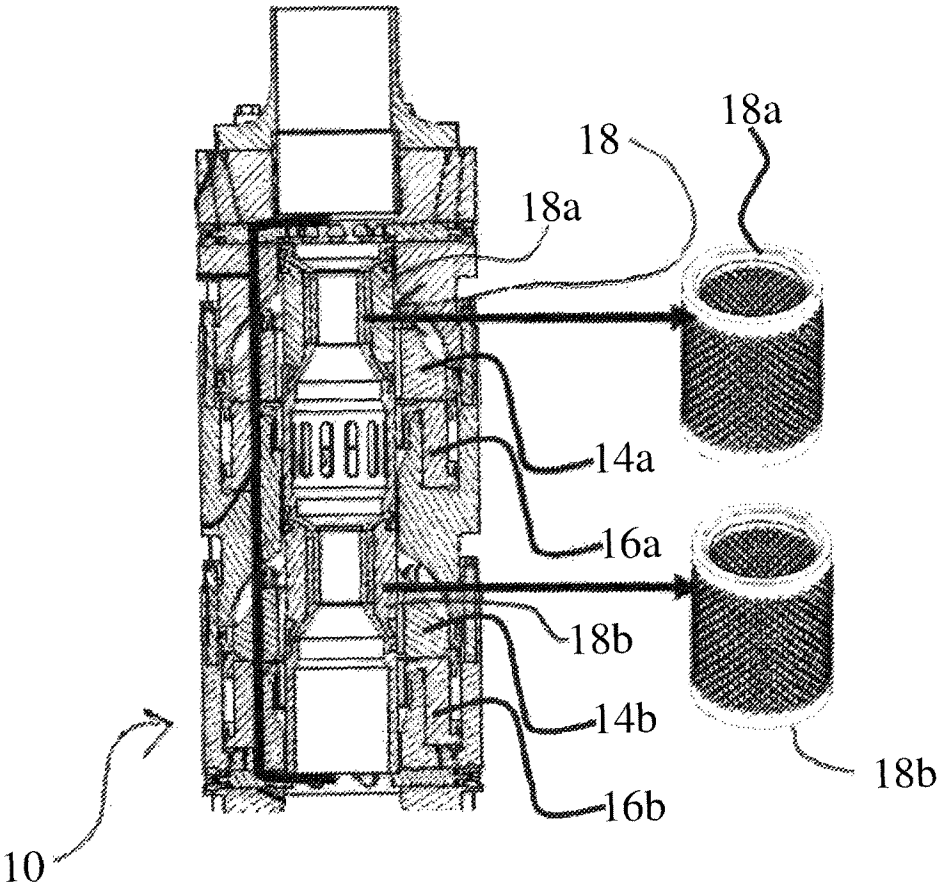
FIG. 2 is an illustration of a longitudinal cross-section through the pressure containment device shown in FIG. 1, including two seals (shown additionally in perspective view) for use in a sealing assembly according to the invention.

According to a first aspect of the present invention, we provide a seal assembly for use in a pressure containment device for containing fluid pressure in an annular space around a drill string whilst allowing the drill string to rotate in the pressure containment device, the seal assembly comprising a seal with a tubular body in which is embedded a wear sensor which emits an alert signal when the inner surface of the seal has been worn away by a preset amount.

The alert signal is preferably discernible by an operator on a drilling rig.

The alert signal may be an electrical signal.

The alert signal may comprise a change in electrical current or voltage.

The wear sensor may include an electrical power supply which has a first pole which is electrically connected to the seal and a second pole which is adapted to be connected to a tubular extending through the seal. In this case, the first pole of the power supply may be electrically connected to an electrically conductive probe embedded in the seal.

The seal assembly may further comprise an electrical output circuit including a switching device.

The switching device may be configured to move from an open position, in which it prevents flow of current around the output circuit, to a closed position to permit flow of electrical current around the output circuit, when the seal has worn by the preset amount. Alternatively, the switching device may be configured to move from a closed position in which it allows flow of electrical current around the output circuit, to an open position, in which it prevents flow of current around the output circuit, when the seal has worn by the preset amount. By virtue of this arrangement, when the seal has worn by the present amount, the current and voltage in the output circuit will change—either falling to zero or increasing from zero, depending on the arrangement of switching device used. Thus, by monitoring the current and/or voltage in the output circuit an operator is made aware when the seal has worn by the preset amount.

The assembly may further comprise a meter for measuring the electrical current passing around the output circuit or the voltage across a part of the output circuit.

The seal assembly may further comprise an electrical power supply, which may be a battery.

The sensor may comprise an inductive proximity sensor which comprises a probe including an inductive coil which is embedded in the seal. In this case, the inductive proximity sensor may be connected to the electrical output circuit.

The alert signal may change as further wear of the seal occurs. By virtue of the alert signal changing in this way, an operative may be issued with a first warning when the seal has worn by a first preset amount, and with a second warning when the seal has worn by a second preset amount.

Where the sensor comprises an electrically conductive probe, the probe may be tapered, the cross-sectional area of the sensor increasing from a first end to a second end. By virtue of providing a tapered probe, when the seal has worn sufficiently that the sensor is now in contact with the drill string, the area of contact between the probe and the drill string changes as the seal and sensor are further eroded. Thus, when a voltage is applied to the probe, the resulting current will change as the degree of wear increases. In this case, preferably the first end of the probe is closest to the inner surface of the seal, whilst the second end of the probe is closest to the outer surface of the seal.

Alternatively, the probe may comprise a plurality of inductive coils which each produce a different size or shape of magnetic field.

Alternatively, the sensor may comprise an electrically conductive element which is embedded in the seal so that wear of the seal by the preset amount breaks the electrically conductive element.

The electrically conductive element may form part of an electrical detection circuit to which power is supplied by the electrical power supply, and the assembly may further comprise a meter for measuring the electrical current passing around the detection circuit or the voltage across a part of the detection circuit. By virtue of this arrangement, when the seal has worn by the present amount, the wear having broken the electrically conductive element, the detection circuit will be broken, and therefore the current and voltage in the circuit will fall to zero. Thus, by monitoring the current and/or voltage in the detection circuit an operator is made aware when the seal has worn by the preset amount.

The alert signal may comprise a pressure signal.

The alert signal may comprise a chemical signal.

The assembly may further comprise a control display which monitors for an alert signal from the seal, and is configured to provide a visual indication, such as lighting a light, that such an alert signal has been emitted. The control display may alternatively or additional emit an audible warning signal if it detects that an alert signal has been emitted.

Where the alert signal comprises a change in voltage or electrical current, the control display may be provided with an analogue or digital display which provides a visual indication of the magnitude of the measured electrical current and/or voltage.

Where the alert signal changes with the degree of wear of the seal, the control display may be configured to provide a first visual indication, such as lighting a first light, that an alert signal has been emitted, and to provide a second visual indication when the alert signal has changed in such a way that indicates that the seal has worn by a second preset amount.

A plurality of wear sensors may be embedded in the seal. In this case, the wear sensors may be spaced in a longitudinal array extending generally parallel to the passage enclosed by the tubular seal. Alternatively or additionally, the wear sensors may be spaced around the circumference of the tubular seal.

Where a plurality of seals are provided, the system is preferably configured to emit the signal when one of the sensors detects that the seal has worn by the preset amount.

The seal may have a non-elastomeric part, and an elastomeric part, the non-elastomeric part forming the inner surface of the seal and being surrounded by the elastomeric part so that the elastomeric part forms the outer surface of the seal.

In this case, preferably the or each sensor is located at the boundary between the non-elastomeric part and the elastomeric part.

According to a second aspect of the present invention we provide a pressure containment device having a seal assembly according to the first aspect of the present invention.

The pressure containment device preferably includes a housing with a main passage, and an actuator which is operable to urge the seal into sealing engagement with a drill string extending through the pressure containment device. The actuator may comprise a piston which is movable generally parallel to the longitudinal axis of the main passage in the housing. The pressure containment device may further include an annular packer which has a central aperture in which the seal is mounted, the actuator being operable to act on the packer so that the packer pushes the seal into engagement with a drill string extending along the main passage of the housing.

According to a third aspect of the present invention we provide a drilling system including a drill string and a pressure containment device according to the second aspect of the present invention.

Embodiments of the present invention will now be described below with reference to the accompanying drawings.

Figure 1:
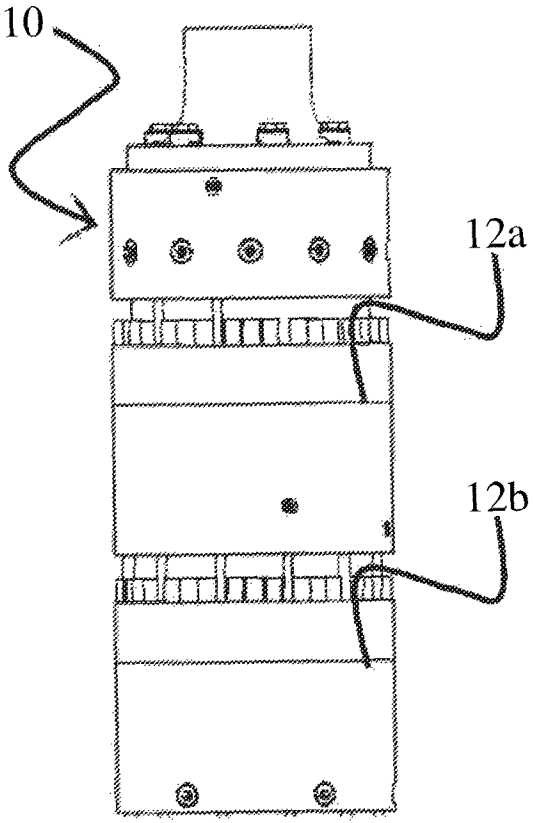
FIG. 1 is a perspective illustration of the housing of a pressure containment device suitable for use in relation to the invention.

Referring to FIGS. 1 and 2, these show a pressure containment device (PCD) 10 suitable for use in connection with the present invention. This embodiment of pressure containment device was described in detail in WO2011128690 and WO2012127227, and this particular embodiment includes two separate sealing assemblies. Each sealing assembly comprises a two part housing 12*a*, 12*b*, each housing 12*a*, 12*b* being tubular and enclosing a main passage, the two housings 12*a* 12*b* being secured together so that their main passages form a continuous main passage through the PCD 10. Each housing 12*a*, 12*b* contains an annular packer 14, an actuator 16, and a tubular seal 18*a*, 18*b* which is surrounded by the packer 14, the actuator 16 being operable to push the packer against the seal 18*a*, 18*b* and thus to urge the seal 18*a*, 18*b* into sealing engagement with a tubular element such as a drill string extending along the main passage of the PCD 10. In this example, the actuator 16 comprises a piston which is movable generally parallel to the longitudinal axis of the main passage through the PCD 10.

In this example, the seals 18*a*, 18*b* are connected together, end to end, to form a single seal sleeve 18.

The seal sleeve 18 is retained within the housing 12*a*, 12*b* using a pair of sets of locking dogs. The locking dogs are hydraulically actuated to move between a first position in which they are retracted into the housing 12*a*, 12*b*, and a second position in which they extend from the housing into the main passage of the PCD 10. When in place, the seal sleeve 18 is captured between the two sets of extended locking dogs, so that the locking dogs act to restrain the seal sleeve 18 from significant vertical movement within the housing 12*a*, 12*b*. When retained in this way, the seal sleeve 18 is positioned concentrically within the housing 12*a*, 12*b* with its upper and lower seals 12*a*, 12*b* situated within the upper and lower annular packer 14*a*, 14*b*.

The PCD 10 may be installed on top of a land based blowout preventer (BOP), or within an offshore riser system to provide the necessary pressure containment required for a given wellbore during pressurized drilling operations. If pressure containment is required, the actuators 16*a*, 16*b* are operated (by the supply of pressurised fluid thereto) so that the packer 14*am* 14*b* urges both seals 18*a*, 18*b* into engagement with the drill string. This is described in more detail in WO2011128690 and WO2012127227.

The two seals 18*a*, 18*b* of the seal sleeve 18 provide a non-rotating seal on the drill string. The PCD 10 is a bearing-less assembly, and the seal sleeve 18 remains stationary as the drill string rotates during drilling or moves vertically within the seal sleeve's 18 internal bore, for example during stripping or tripping operations, or, where the drill string is suspended from a floating drilling rig, due to movement of the drilling rig with the swell of the ocean.

When a seal is pushed into engagement with the drill string as described above, this relative movement will result in frictional forces between the seal 18*a*, 18*b* and the drill string and consequent wear of the seal. The materials from which the seals 18*a*, 18*b* are constructed are selected to reduce wear of the seal and heating effects due to frictional forces between the seal 18*a* 18*b* and the drill string.

In particular, in one embodiment, the seal, which is in contact with the drill string, is a polymeric material selected to provide such properties whilst having the mechanical integrity to provide an effective seal. Polymers such as polytetrafluoroethylene (PTFE) or Teflon™, a PTFE based polymer or ultrahigh molecular weight polyethylene (UHMWPE) may be used. Additives or fillers such as fibreglass, molybdenum disulphide and/or tungsten disulphide may be included in the seal 18*a*, 18*b* to reduce the coefficient of friction and improve the wear resistance of the seal 18*a*, 18*b* and therefore the operation life of the seal sleeve 18. Moreover, in order to improve the conduction of heat arising from friction between the seal 18*a*, 18*b* and the drill string away from the contact surface (with the aim of reducing thermal degradation of the seal 18*a*, 18*b*), the seal 18*a*, 18*b* may also include a thermally conductive filler—metallic or graphitic fibres or particles, for example.

To provide the seal 18*a*, 18*b* with the necessary resilience to move out of engagement with the drill string when pressure from the adjacent packer 14*a*, 14*b* is released, in one embodiment, the seal 18*a*, 18*b* also has a part 26 which is made from an elastomeric material. The elastomeric part 26 may be made from polyurethane or hydrogenated nitrile butadiene rubber, for example, in addition to a non-elastomeric part 24. In this example, both the elastomeric 26 and non-elastomeric parts 24 are tubular, with the elastomeric part 26 being arranged around the exterior surface of the non-elastomeric part 24, so that the non-elastomeric part 24 forms the inner surface of the seal 18*a*, 18*b* and, in use, it is the non-elastomeric part 24 which contacts the drill string.

The elastomeric part 26 and the non-elastomeric part 24 may be fabricated as separate tubes and placed in mechanical engagement with one another, or they may be co-moulded to form a single part. In one embodiment of seal 18*a*, 18*b*, the non-elastomeric part 24 includes a plurality of apertures (preferably radially extending apertures), and the elastomeric part 26 is cast or moulded onto the non-elastomeric part 24 so that the elastomeric material extends into, and preferably substantially fills these apertures. The non-elastomeric part 24 may have a cross-hatched, mesh or honeycomb structure, in which the apertures in the honeycomb mesh structure extend from the radially outward surface to the radially inward surface of the seal 18*a*, 18*b* generally perpendicular its longitudinal axis. This is preferably formed by machining a cylindrical bar of polymer.

Advantageously, the seal 18*a*, 18*b* is mounted between two generally annular support plates 22 made from a substantially rigid material. The support plates 22 are typically metallic. In this case, the support plates 22 form part of the seal sleeve 18, with the lowermost support plate for the uppermost seal 18*a* being integral with or secured to the uppermost support plate for the lowermost seal 18*b*.

As mentioned above, a PCD of this type has been described previously in WO2011128690 and WO2012127227. The present invention resides in embedding a wear sensor in one or both of the seals 18*a*, 18*b*. The wear sensor enables an operator to monitor the wear of the seal 18*a*, 18*b*, and thus provide an operator with an indication as to when the seal sleeve 18 needs replacement. The result is a proactive and preventative method for the wear monitoring within the seal sleeve 18.

The wear sensor is configured to emit a warning signal when the seal 18*a* 18*b* has worn by a preset amount, the warning signal being detectable by an operator on the drilling rig, so that the operator may respond by taking the necessary steps to retrieve and replace the seal sleeve 18 before the wear results in a significant or catastrophic failure of the PCD 10.

Where the seal 18*a*, 18*b* is made from an elastomeric/non-elastomeric composite as described above, it is proposed to position the sensor at or in close proximity to the boundary of the elastomeric and non-elastomeric materials. It should be appreciated, however, that the sensor can be embedded within any single elastomeric or non-elastomeric seal, or within any seal comprised of varied composites.

The sensor may be co-moulded into the core structure of the seals 18*a*, 18*b* contained within the seal sleeve 18. The sensor is miniscule in size and composed of a material such that the strength and flex rating of the seal 18*a*, 18*b* is not significantly affected, but have a degree of flex so that they will not fatigue, fail, or break as the seal 18*a*, 18*b* flexes and plastically deforms from the loads imposed from drilling, and/or stripping or tripping.

Figure 4:
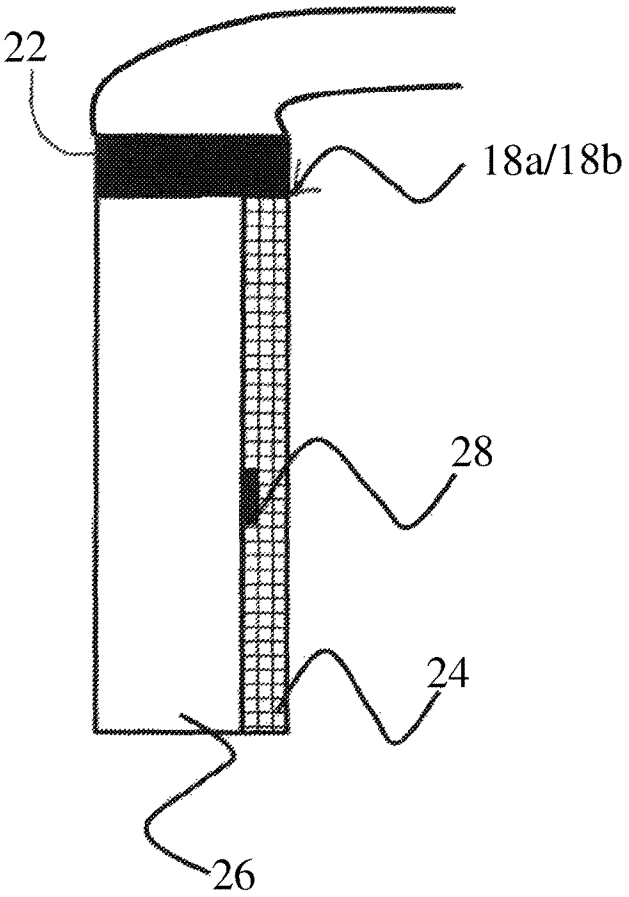
FIG. 4 illustrates a portion of a longitudinal cross-section through a seal for use in a sealing assembly according to the invention.
Figure 3B:
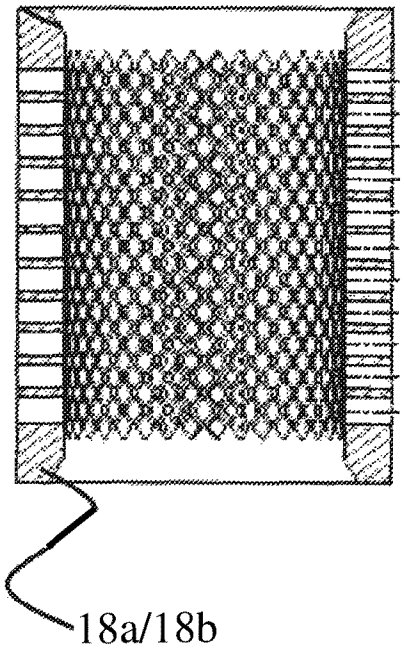
FIGS. 3*a* and 3*b* show two alternative longitudinal cross-sections through a seal suitable for use in the pressure containment device shown in FIGS. 1 and 2.
Figure 3A:
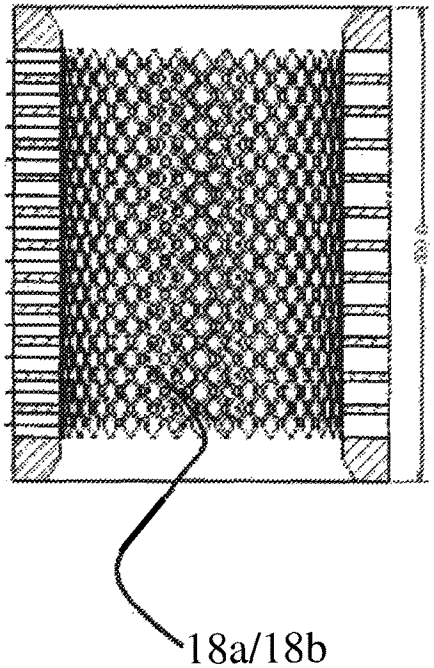
Figure 5:
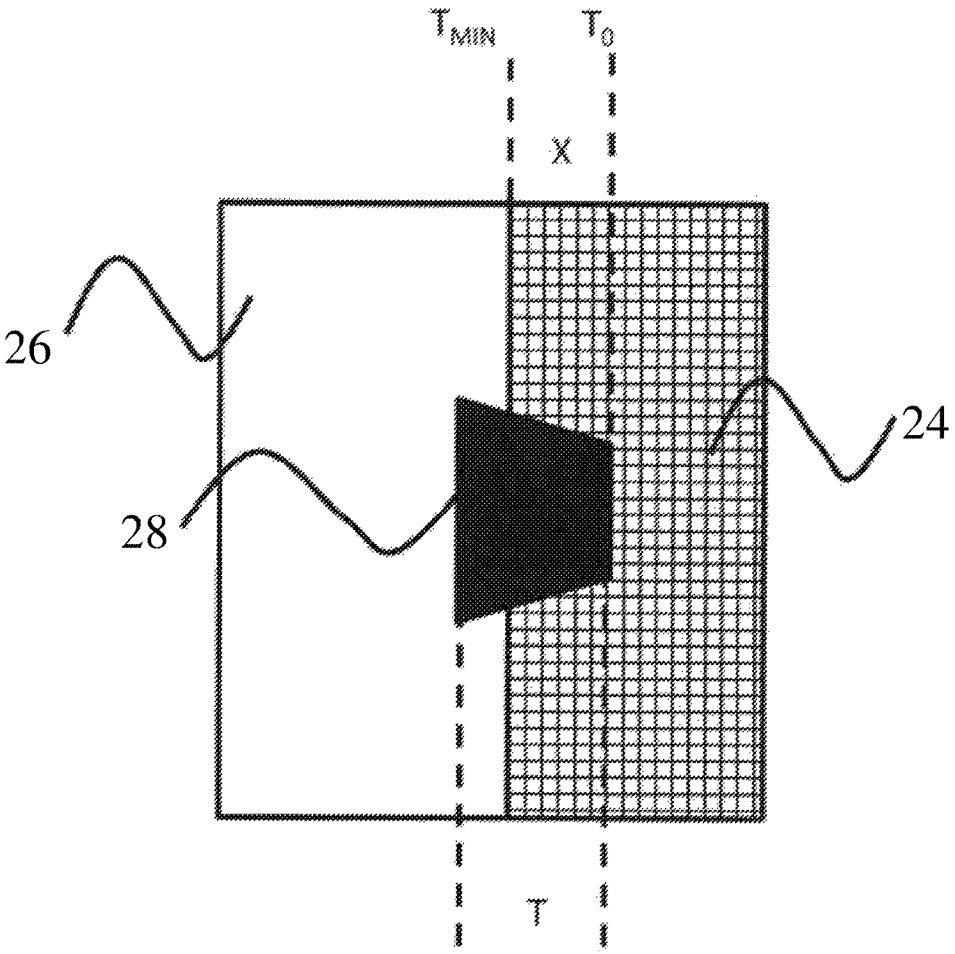
FIG. 5 illustrates a portion of a longitudinal cross-section through an alternative embodiment of seal for use in a sealing assembly according to the invention.

Referring to FIG. 4, this shows an illustration (not to scale) of a longitudinal cross section of a portion a seal 18*a*, 18*b*, and an advantageous positioning of such a wear sensor 28. The sensor is embedded within the seal 18*a*, 18*b*, and extends a distance X into the non-elastomeric part 24 of the seal 18*a*, 18*b*. The sensor's position is such that its total thickness extends from the edge of the elastomeric part 26 into the non-elastomeric part 24 of the seal.

In one embodiment of the present invention, the sensor 28 comprises a single tapered probe embedded in the sealing element, as illustrated in FIGS. 5 and 6*a*, 6*b*, and 6*c*. It is appreciated the probe 28 may be encased in a flexible silicon resin or other protective coating which confines it within its embedded position, similar to resins which encapsulate the electronics of downhole drilling tools, well known in the art.

The probe 28 is arranged so that its smaller cross-section end is closest to the interior surface of the seal 18*a*, 18*b* whilst its larger cross-section end is closest to the exterior surface of the seal 18*a*, 18*b*. In the embodiment illustrated in FIGS. 5 and 6*a*, 6*b* & 6*c*, the probe 28 is embedded in a non-elastomeric/elastomeric composite seal 18*a*, 18*b*, and the larger cross-section end of the probe 28 is embedded in the elastomeric part 28 whilst the smaller cross-section end is embedded in the non-elastomeric part 24.

In this example, the probe 28 has a tapered trapezoidal shape. It should be appreciated, however, that other shapes may equally be used, provided the cross-sectional area of the probe increases from one end to the other. Moreover, whilst in this example, the end closest to the interior surface of the seal 18*a*, 18*b* has the smallest cross-sectional area, this need not be the case, and the sensor may be oriented the other way round with the smallest end closest to the exterior surface of the seal 18*a*, 18*b*.

The tapered probe design 13*a* may be used to correlate the degree of wear within the non-elastomeric component of the sealing element.

Figure 6C:
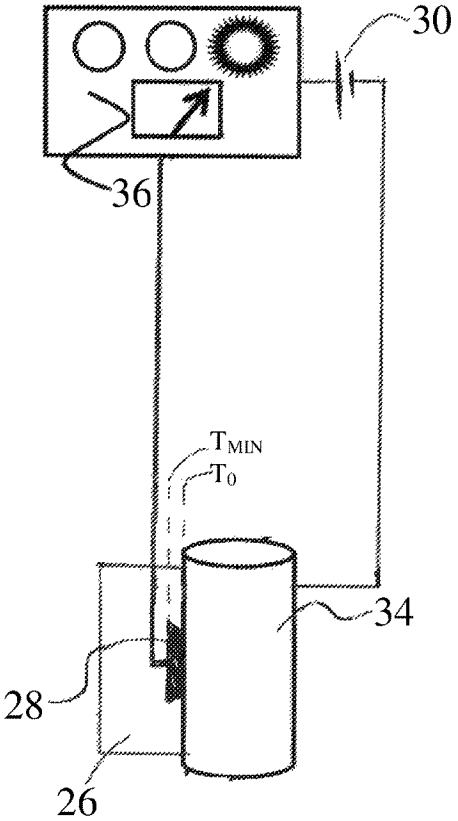
FIG. 6 illustrates a sealing assembly according to one embodiment of the invention with a) the seal in its new, in worn state, b) the seal partially worn, and c) the seal worn and at the end of its useful life.
Figure 6B:
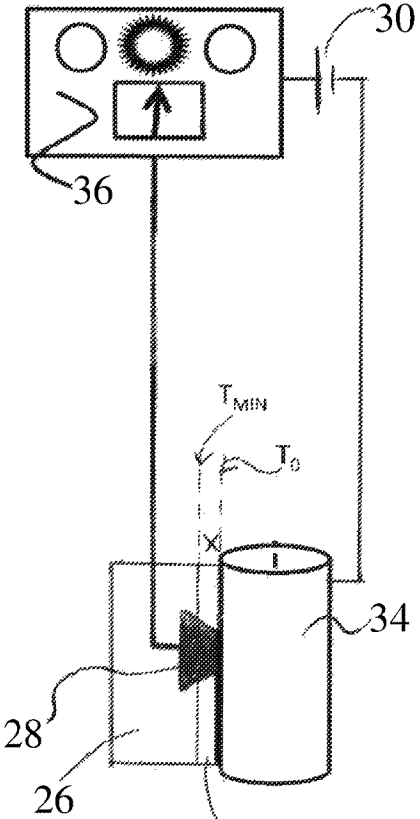
Figure 6A:
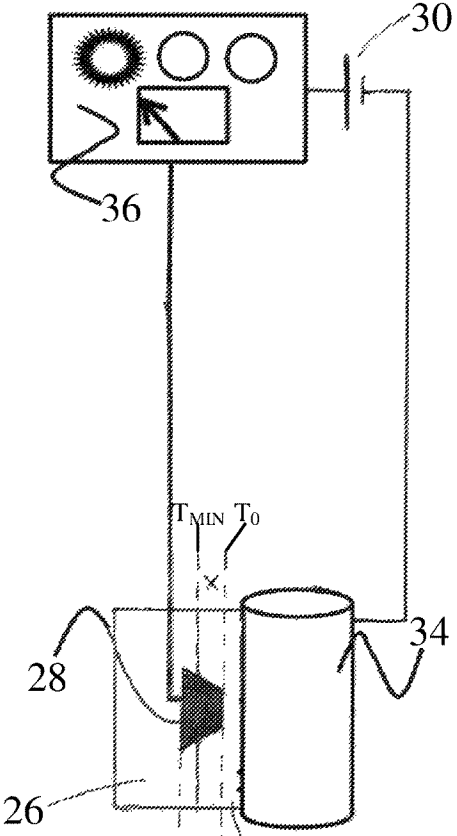

An example of an electrical circuit 30 in which the probe 28 may be provided is illustrated schematically in FIGS. 6*a*, 6*b*, & 6*c*. In this example, one pole of an electrical power supply 30 (e.g., a battery) is connected to the probe via a meter for measuring the magnitude of the electrical current flowing along circuit 30, the meter sending an output signal to a control display 36 which provides a visual indication of this measurement. The other pole of the electrical power supply 30 is connected to a tubular 34 such as a drill pipe passing through the seal 18*a* 18*b* in which the probe 28 is located. The meter could alternatively comprise a voltmeter. In the embodiment illustrated in FIGS. 6*a*, 6*b*, 6*c*, the control display includes a digital or analogue indicator (in this example, a needle and dial arrangement) which shows on a continuous basis, the magnitude of the current in the circuit, and a set of three lights, which may be different colours (green, amber and red, for example).

FIG. 6*a* illustrates the probe 28, and associated circuitry, with the seal 18*a*, 18*b* in its unused state, in which sufficient thickness remains within the seal 18*a*, 18*b*, illustrated by the drill pipe 34 not being in direct contact with the probe 28. The circuit is open and the voltage or current reading is zero on the control display 36, in this example, with the first (possibly green) light indicating a safe thickness remains in the element.

In FIG. 6*b*, the initial thickness of the seal has worn away to $T_0$ and the drill pipe 34 contacts the probe 28, causing a current to flow in the circuit. This is detected by the meter, and the control display 36 issues a precautionary warning—in this example by lighting the second (maybe amber) light. This signifies operating thickness X remains in the seal.

If use of the seal 18*a*, 18*b* during drilling continues, the seal 18*a*, 18*b* continues to wear. As the seal 18*a*, 18*b* wears, so does the probe 28, and the area of contact between the probe 28 and the drill pipe 34 increases because of the tapered design. The probe 28 is made from a conductive material (such as copper, silver, or gold or alloys based on these metals) which is softer than the tubular steel so that it will not damage the tubular as it wears away from the drill pipe 34 rotation or reciprocation. The continuously increasing probe surface contact area on the drill pipe 34 increases the magnitude of the current in the output circuit in a way that is correlated to the thickness remaining within the seal 18*a*, 18*b*. This is displayed on the needle and dial arrangement of the control display 36.

Advantageously, the control display 36 is configured to light the third (maybe red) light, when the magnitude of the current in the output circuit corresponds to a thickness X of the probe 28 having worn away, i.e., the seal 18*a*, 18*b* having worn down to its minimum safe operating thickness $T_{MIN}$. An audible alarm may also be triggered at this point. The light and alarm on the control display 36 indicate that the seal sleeve needs to be replaced, as the sealing element has now breached the minimum safe operating thickness $T_{MIN}$.

Thus it is appreciated this method uses the tapered probe 28 to correlate the voltage or current value to the thickness remaining within the seal 18*a*, 18*b* from $T_0$ to $T_{MIN}$. For example, when the drill pipe 34 first contacts the tapered probe 28 at $T_0$, a 4 mA current may be detected. As the probe 28 erodes as the seal 18*a*, 18*b* wears, the transmitted current increases as the probe's area of contact with the drill pipe 34 increase, up to a maximum current of 20 mA. This is where the sealing element thickness reaches $T_{MIN}$ and the seal sleeve requires replacing.

Whilst using a tapered probe 28 is advantageous, it is not essential.

Figure 7:
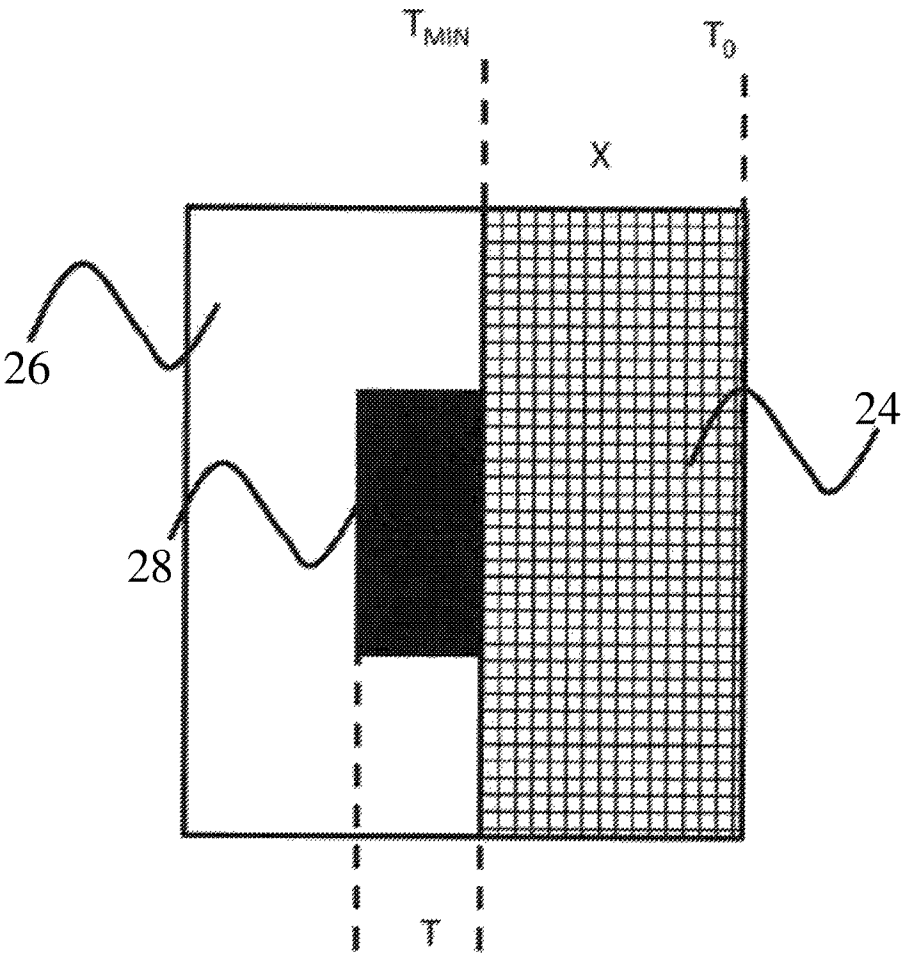
FIG. 7 illustrates a portion of a longitudinal cross-section through a further alternative embodiment of seal suitable for use in a sealing assembly according to the invention.

Referring now to FIG. 7, there is shown a portion of cross section of a segment of a seal 18*a*, 18*b* including an alternative probe positioning using a flush probe 28 (i.e., not tapered). A flush probe 28 is embedded within the seal 18*a*, 18*b* such that its thickness T results in its contact surface (i.e., the face closest to the interior surface of the seal 18*a*, 18*b*) positioned at or near adjacent to the boundary between the elastomeric part 26 and non-elastomeric part 24 of the seal 18*a*, 18*b*.

In this embodiment, $T_0$ is the initial thickness of the seal 18*a*, 18*b* when the seal sleeve 18 is installed and put into operation. $T_{MIN}$ is the minimum safe operating thickness of the seal 18*a*, 18*b*. Thus X is the operational thickness or "operating life" of the seal 18*a*, 18*b*. When the seal 18*a*, 18*b* wears from $T_0$ to $T_{MIN}$, the contact between the drill pipe and the probe 28 simply closes the circuit, and a single precautionary alarm is raised indicating the seal sleeve needs to be replaced. The probe 28 is not tapered so there is no correlation between the voltage or current in the output circuit 30 with the thickness remaining within the seal 18*a*, 18*b*.

In an alternative embodiment of the present invention, instead of being made from an electrically conductive material, the probe 28 may be a resistor which is connected to a circuit in exactly the same way as the probe illustrated in FIG. 6*a*, 6*b*, 6*c*. As the probe 28 is worn away, its resistance will be reduced, and so the current flowing around the circuit will increase. In this case, the probe 28 may be shaped as illustrated in FIG. 7, i,e, not tapered, but still provide a correlation between voltage or current in the output circuit with the thickness remaining within the seal 18*a*, 18*b*.

In fact, it is possible to dispense with the probe completely, and simply to connect the seal 18*a*, 18*b* to one pole of the electrical power supply 30 and the tubular 34 to the other. Thus, the entire seal 18*a*, 18*b* acts as a large resistor whose resistance reduced as it is worn down, thus increasing the current flowing around the circuit.

In a further alternative embodiment of the present invention, the sensor 28 comprises an inductive proximity sensor.

Proximity sensors are well known in the art for their use in drilling rig sensors, such as rig pump stroke sensors. Proximity sensors open or close an electrical circuit when they make contact with or come within a certain distance of an object. There are four basic types of proximity sensors—infrared, acoustic, capacitive, and inductive. Inductive proximity sensors sense the distance to objects by generating magnetic fields, which is similar in principle to metal detectors. Generally they are powered by a direct current (DC) source of low voltage.

Figure 8B:
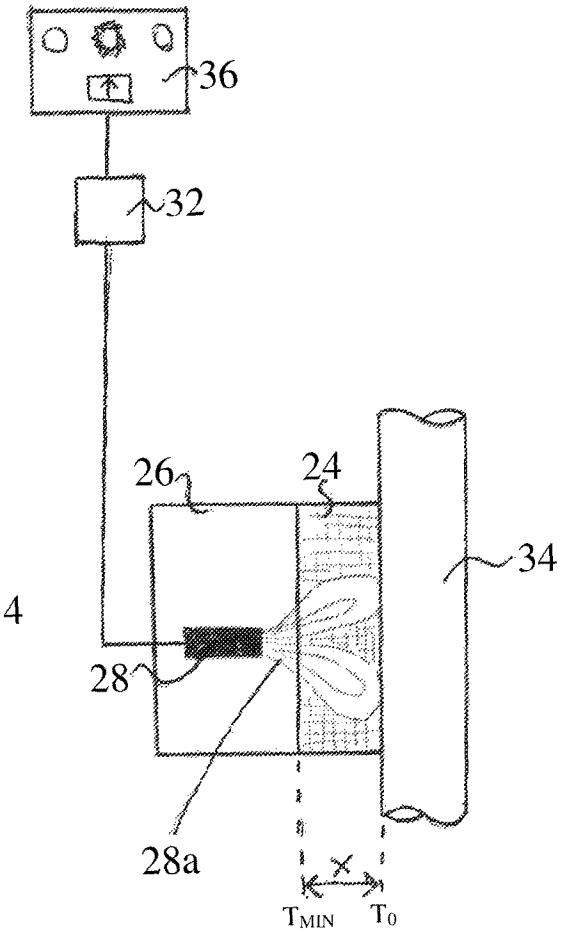
FIG. 8 illustrates a sealing assembly according to an alternative embodiment of the invention with a) the seal in its new, unworn condition, and b) the seal in a worn condition.
Figure 8A:
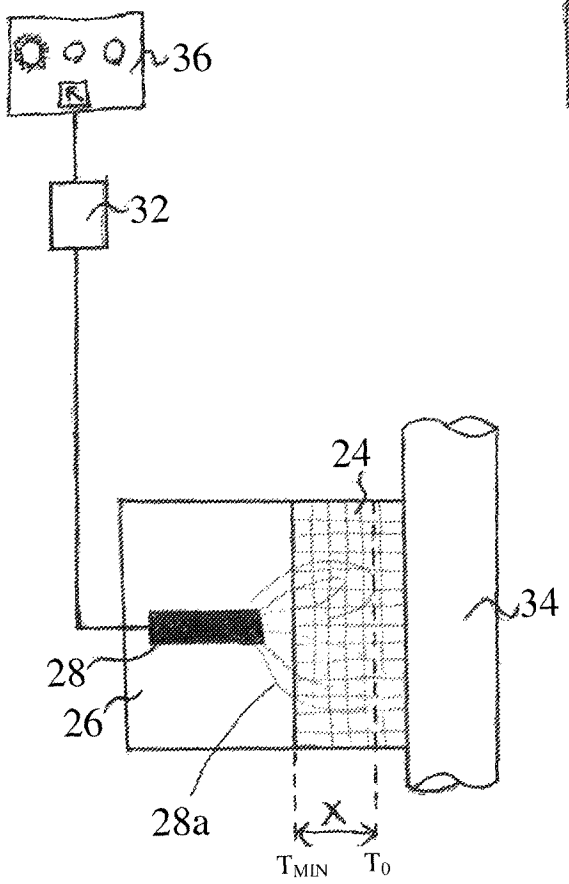

The main advantage of inductive proximity sensors versus the other three types is that they can only detect metallic objects, for example the steel material of a drilling tubular. They will detect metal through a layer of non-metal material, for example a steel drill pipe through an elastomeric or non-elastomeric sealing element. An example of an inductive proximity sensor is illustrated in FIGS. 8*a* and 8*b*, and consists of an oscillator circuit (the sensing aspect) including the probe 28, and an output circuit 32 including a switching device (the transistor aspect), all housed in a resin encapsulated body. The probe 28 comprises a coil of wire, referred to as the inductance coil, which is charged with a small electrical current and which creates a magnetic field 28*a* as a result. For the purpose of this patent application, this inductance coil will be referred to as the probe. If a metallic or steel part such as tubular 34 gets close enough to the probe 28, the magnetic field created by the probe is disturbed and, the output circuit 32 responds by closing the output switch and completing the output circuit. This is illustrated in FIG. 8*b*. Completion of the output circuit is confirmed by the measurement of a small voltage (V) or current (milliamp, mA) using the ammeter or voltmeter 36.

Each inductive proximity sensor is configured so that completion of the output circuit is triggered when the probe is a certain pre-determined distance from a metallic object. This pre-determined distance can be varied from sensor to sensor, but, conventionally, a given sensor provides a binary output—either the sensor is greater than the pre-determined distance from a metallic object (when there is zero current or voltage in the output circuit) or it is at or less than the pre-determined distance from a metallic objection (in which case there is a current in the output circuit). Typically, there is no correlation between the magnitude of the current in the output circuit and the distance between the probe and the metallic object.

As such, where a conventional inductive proximity sensor is used, if it is desired to provide multiple outputs, it may be necessary to use a plurality of sensors which are set to provide an output signal at different probe/metallic object separations. For example, a first inductive proximity sensor may be provided to give a signal when the seal 18*a*, 18*b* has worn down by a first amount to warn that the seal will need replacing soon, and a second inductive proximity sensor may be provided to give a signal when the seal 18*a*, 18*b* has worn down by a second, greater, amount to warn that the seal needs replacing immediately Whilst in the embodiments described above, a single probe 28 is embedded in each seal 18*a*, 18*b*, each seal 18*a*, 18*b* may be provided with a plurality of wear sensors. These may be spaced longitudinally along the seal 18*a*, 18*b* and/or arranged in various angular positions around the circumference of the seal 18*a*, 18*b*. They may also be placed at varying depths in the seal 18*a*, 18*b*.

With a drill pipe 34 present and extending through the sealing element internal bore, by having the sensors 28 distributed radially and longitudinally, it is possible to better detect non-uniform wear within the non-elastomeric sealing material. A single sensor 28 does not provide this capability. The sensors may be concentrated in the region of the seal 18*a*, 18*b* where the highest wear rate is anticipated, in contrast to throughout the entire structure. Given the sealing profile of the element on the drill pipe 34, this positioning is where the greatest sealing pressure exists and at points where the largest pressure differential is occurring.

Figure 9:
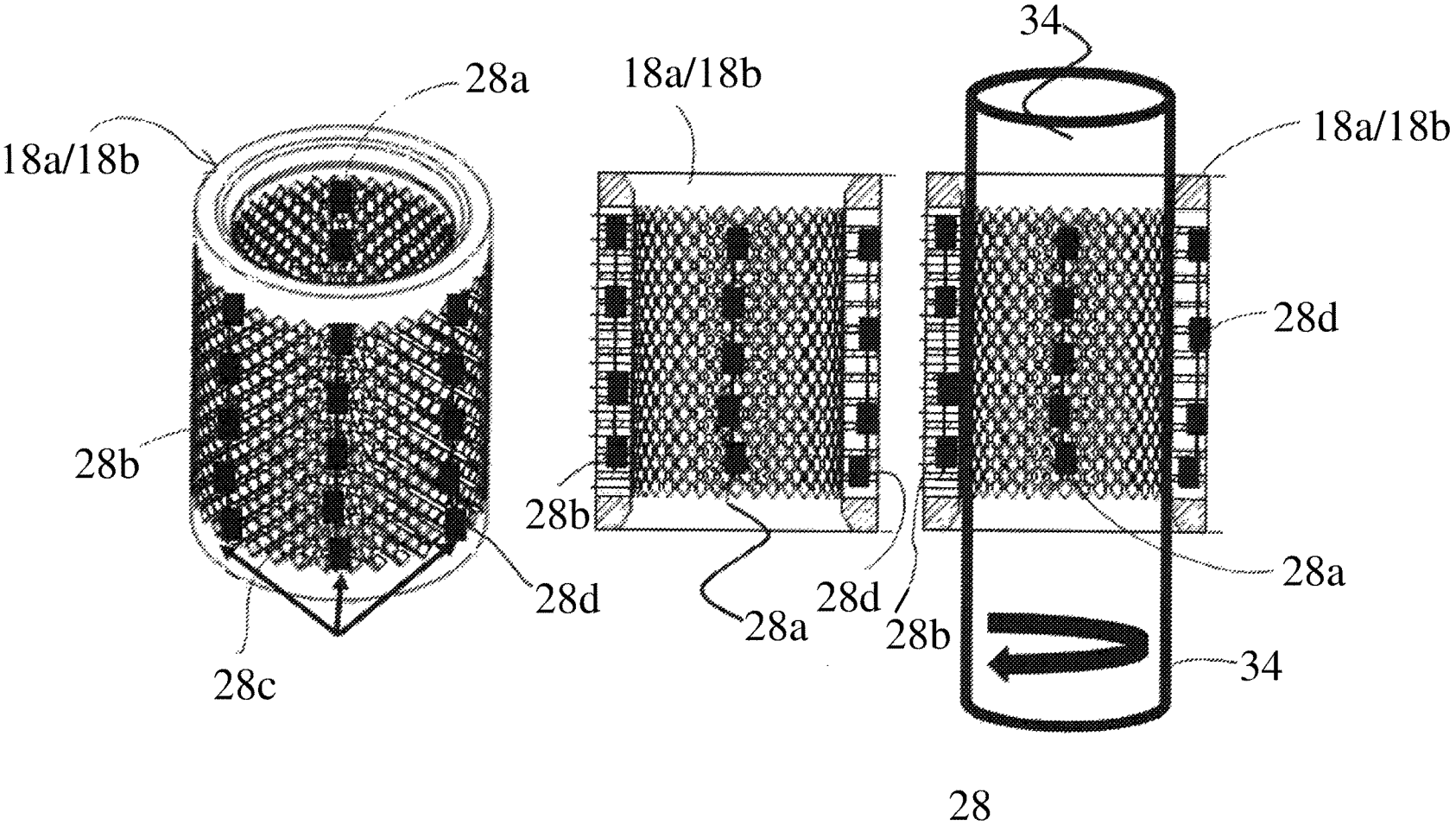
FIG. 9 illustrates a cross section of a seal suitable for use in a further embodiment of sealing assembly in accordance with the invention revealing probes situated radially as a network within the seal.

Referring now to FIG. 9, this shows an embodiment of seal 18*a*, 18*b* in which is embedded a network of wear sensors 28 arranged in a plurality of longitudinal arrays 28*a*, 28*b*, 28*c*, 28*d* within the seal 18*a*, 18*b*.

Figure 10:
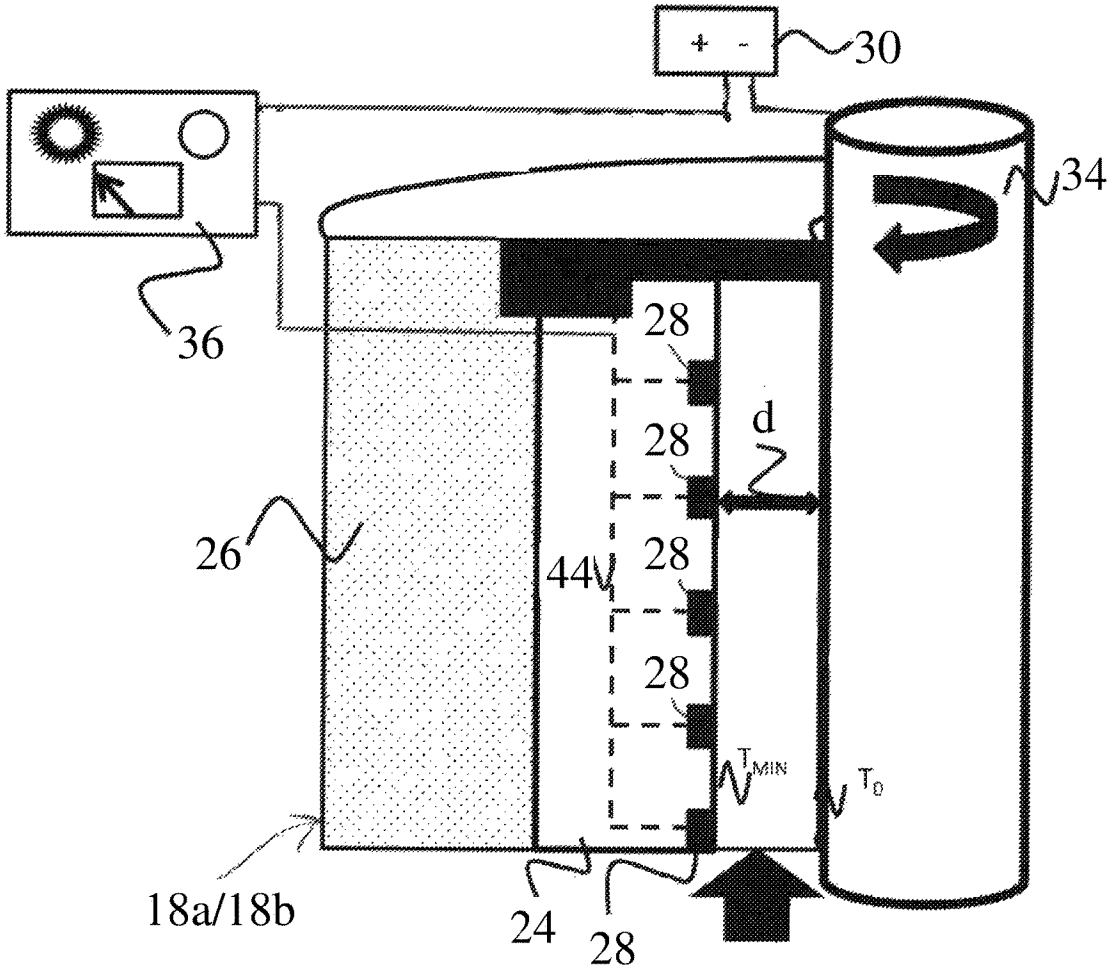
FIG. 10 illustrates a cutaway cross section of the seal illustrated in FIG. 9 in use in a sealing assembly according to the invention.
Figure 11:
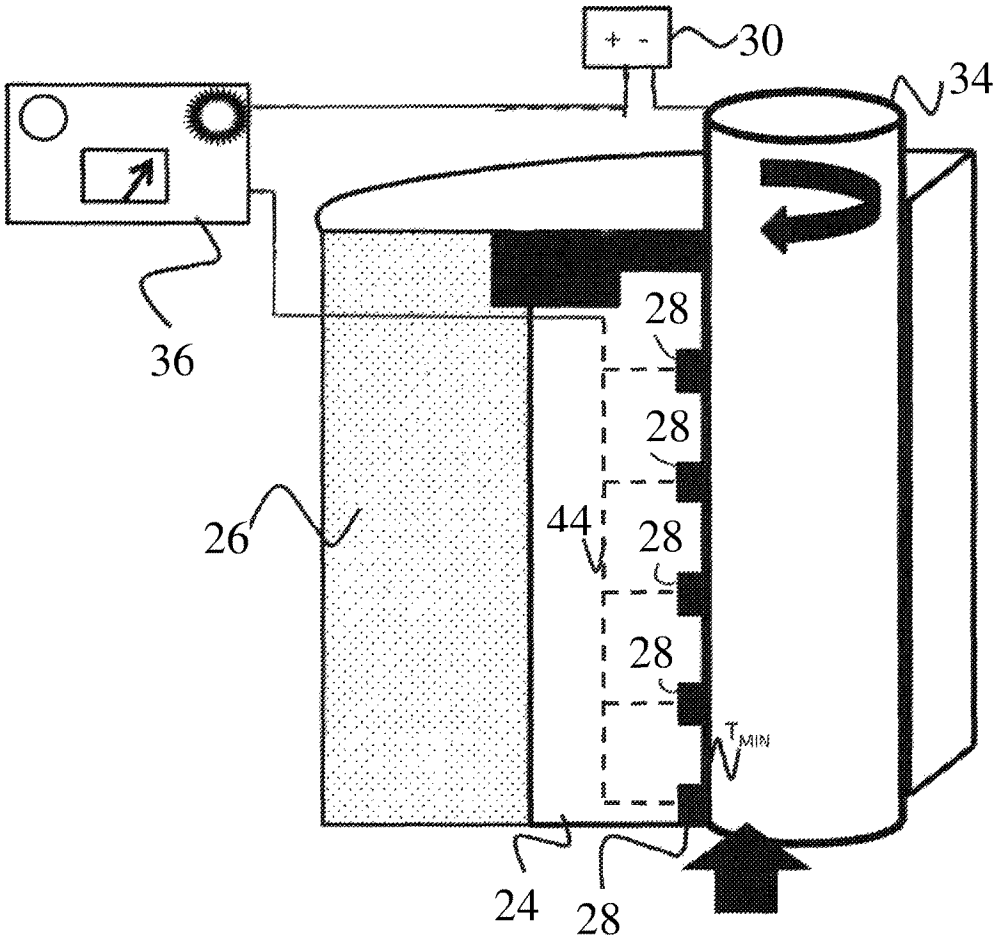
FIG. 11 illustrates a cutaway cross section of the seal illustrated in FIG. 9 with the seal in a used, worn, state, wear detected and the seal requiring replacement.

Whilst any sort of wear sensor may be used in such a network, an embodiment of the present invention is illustrated in FIGS. 10 and 11 which uses multiple probes, specifically the flush probe described in relation to FIG. 7. The probes 28 are connected to one pole of the electrical power supply 30 by a flexible conductive material such as, but not limited to, high strength electrical wire 44 co-moulded into the seal 18*a*/18*b*. The probes 28 are all co-moulded into the structure within close proximity to the elastomer-non-elastomer interface of the seal 18*a*/18*b*.

A drilling tubular (drill pipe 34) extends through the internal bore of the seal 18*a*/18*b*, shown as a simple cutaway cross section, and is rotating or moving vertically up or down within the seal 18*a*/18*b*. The tubular 34 is connected to the other pole of the electrical power supply.

As described above, the seal 18*a*/18*b* is confined between upper and lower annular support plates (not shown in FIG. 10 or 11). The non-elastomeric part 24 of the seal 18*a*/18*b* engages with the drill pipe 34 through the applied force of the annular packer 14 against the external surface of the seal 18*a*/18*b*, producing the non-rotating seal by the radial contact and force of its non-elastomeric sealing face on the drill pipe 34. The initial seal element thickness is defined as $T_0$, with the standoff 22 defined as the safe operating range from $T_0$ to $T_{MIN}$, until the element thickness reaches the minimum acceptable safe operating limit $T_{MIN}$.

FIG. 10 illustrates the seal 18*a*/18*b* in its as new condition in which there is negligible wear of the non-elastomeric part 24 indicated by the standoff distance d between the drill pipe 34 and the probe network 28. The sealing element containing the probe network 28 remains stationary and does not rotate with the drill pipe 34. There is no contact between any of the probes 28 and the tubular 34 and hence the electrical circuit from the power supply 30 is not complete and no current flows.

The digital or analogue readout on the control display 36 measures zero volts or milliamps (mA), and the first (maybe) green light is lit. This indicates that a satisfactory seal thickness is present within a range between $T_0$ to $T_{MIN}$.

As drilling progresses, the seal 18*a*/18*b* wears to thickness $T_{MIN}$. This is illustrated in FIG. 11. At this point, the steel of the drill pipe 34 contacts one or more probes 28 within the network, a current flows, and the voltage or current measured and displayed by the control display 36 increases. Preferably this causes a second light (maybe a red light) on the control display 36 to be lit, and possibly an audible alarm sounded, indicating it is time to replace the seal sleeve 18, as its operational life has been exhausted.

Inductive proximity sensors may, of course, be used in such an arrangement. In this case, a low voltage or current, typically less than 10 volts or mA, is supplied to the network of inductive proximity sensors to produce a circular magnetic field within the probe network. A switching device in the output circuit 32 remains open as the unworn seal 18*a*, 1*b* ensures that the drill pipe 34 does not come close enough to any of the probes 28 to disturb the magnetic field of any of the probes 28. Again, the digital or analogue readout on the control display 36 measures zero volts or milliamps (mA), and the first (maybe) green light is lit. This indicates that a satisfactory seal thickness is present within a range between $T_0$ to $T_{MIN}$.

When the seal wears to thickness TMIN, the steel of the drill pipe 34 interrupts the magnetic field at one or more of the probes 28 within the network, the switching device in the output circuit 32 closes, a current flow in the output circuit 32, and the voltage or current measured and displayed by the meter 36 increases. When this occurs, the drill pipe 34 may or may not be in contact with a single or multiple probes 28 of the network, but in either case, the circular magnetic field is interrupted when it is in close proximity to the probe network. Again, preferably this causes a second light (maybe a red light) on the control display 36 to be lit, and possibly an audible alarm sounded, indicating it is time to replace the seal sleeve 18, as its operational life has been exhausted.

Figure 12:
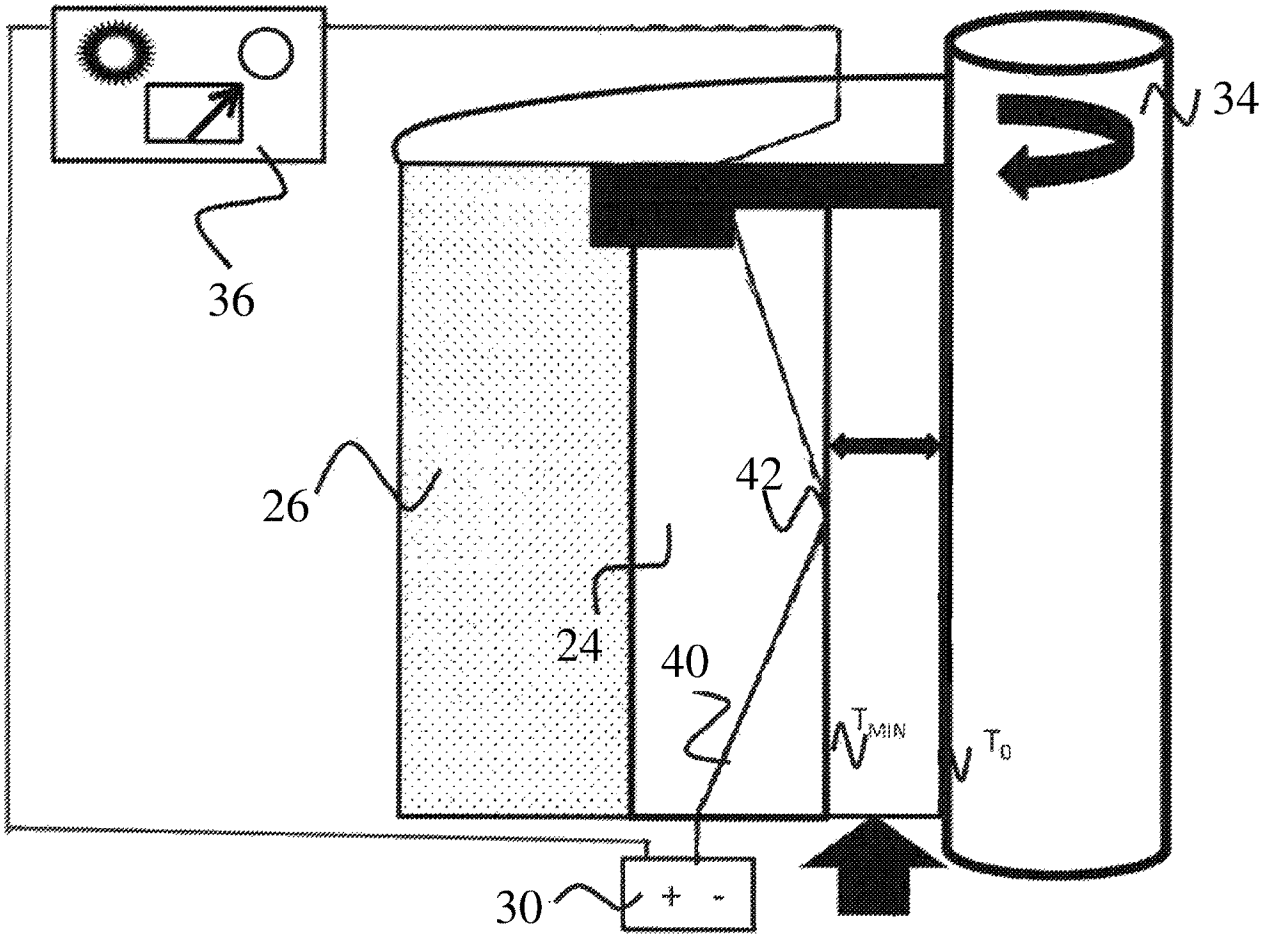
FIG. 12 illustrates a cutaway cross-section of a further embodiment of sealing assembly according to the invention, in the absence of sealing element wear.
Figure 13:
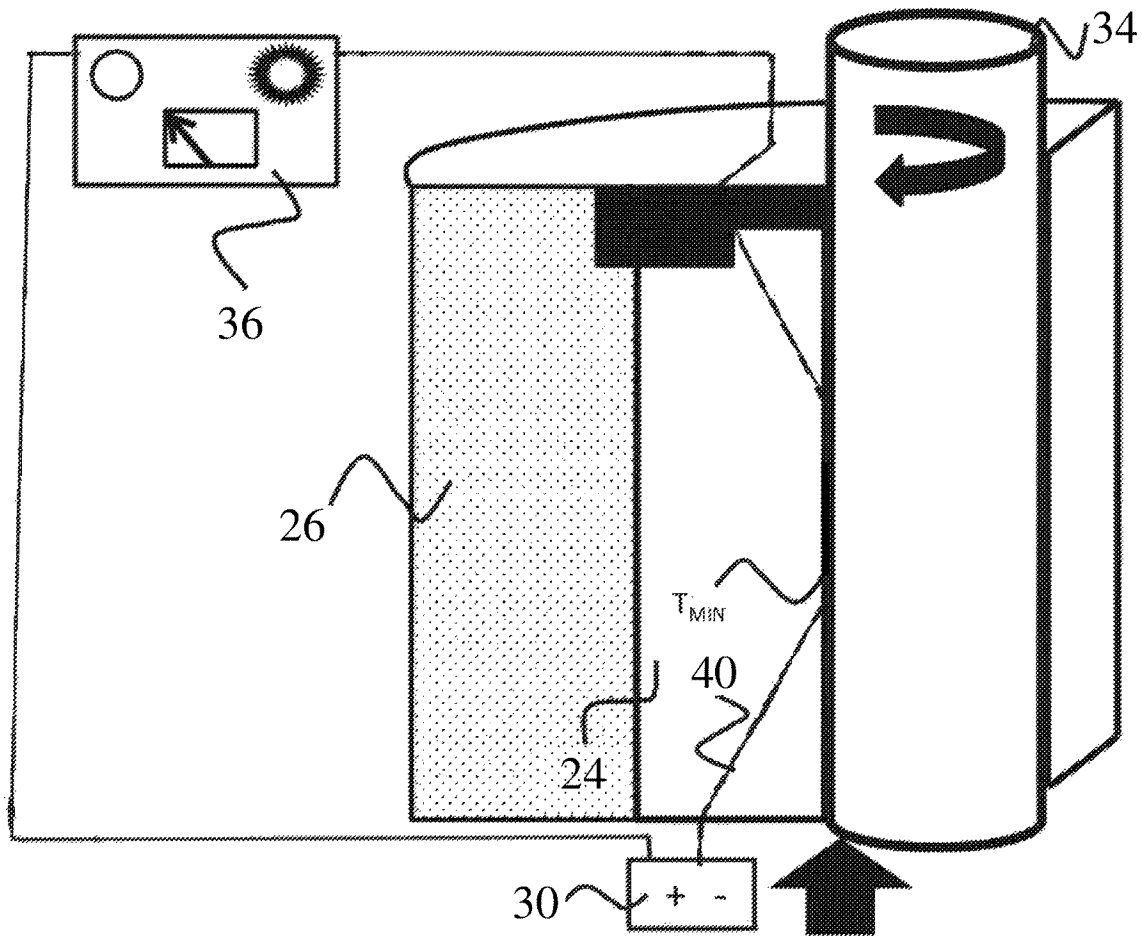
FIG. 13 illustrates the sealing assembly shown in FIG. 12 with the seal used and worn, wear detected and the seal sleeve requiring replacement.

An alternative wear monitoring system utilizing an open circuit or "circuit break" methodology is illustrated in FIGS. 12 and 13. In this embodiment, there are no probes embedded within the seal 18*a*/18*b*. Instead, a low voltage or current supply 24 connects at a first end of the seal 18*a*/18*b* with a high strength ductile wire or cable (circuit wire 40) which extends through the seal 18*a*/18*b* from its first end to its second end. The circuit wire 40 is co-moulded into the elastomeric part of the seal 18*a*/18*b*, and extends towards the interior surface of the seal 18*a*/18*b*. The circuit wire 40 may be encased in a flexible resin within the seal 18*a*/18*b*, similar to resins which encapsulate the electronics of downhole drilling tools, well known in the art.

A point at which the circuit wire 40 is closest to the interior surface of the seal 18*a*/18*b* is designated a detection point 42, and in this embodiment, the circuit wire 40 extends to a single detection point 42 adjacent to the boundary between the elastomeric part 26 and non-elastomeric part 24. The single detection point 42 defines the minimum safe operating limit $T_{MIN}$ of the sealing element. It should be appreciated, of course, that whilst in this example a single detection point 42 is shown multiple detection points may be provided.

The circuit wire 40 forms part of a circuit which includes a low voltage supply 30 At conditions of acceptable wear, the thickness of the sealing element is within the range of $T_0$ to $T_{MIN}$, circuit wire 40 is intact at the detection point 42, the circuit is closed. The resulting electrical current is detected by the meter 36, which displays that information, and, in this embodiment, lights a first (maybe green) light, to provide a visual indication that the seal 18*a*/18*b* is operating safely. This is illustrated in FIG. 12.

Referring now to FIG. 13, this illustrates the point at which the seal 18*a*/18*b* has been worn to thickness $T_{MIN}$. At this point, the steel of the drill pipe 34 contacts the circuit wire channel 40, and ruptures or breaks the circuit wire 40 at the point of contact—detection point 42. This breaks the continuity of the circuit and the voltage supply from the battery 38 is lost. The loss of current/voltage is detected by the meter 36 which displays the current/voltage (zero in value) and, advantageously lights a second (maybe red) light to provide a visual indication that $T_{MIN}$ has been breached and the seal sleeve requires replacement. As before, the meter 36 may also be configured to sound an audible alarm at this point.

It should be appreciated that the low voltage supply 24 may cease automatically once the break in the circuit is detected.

Figure 14:
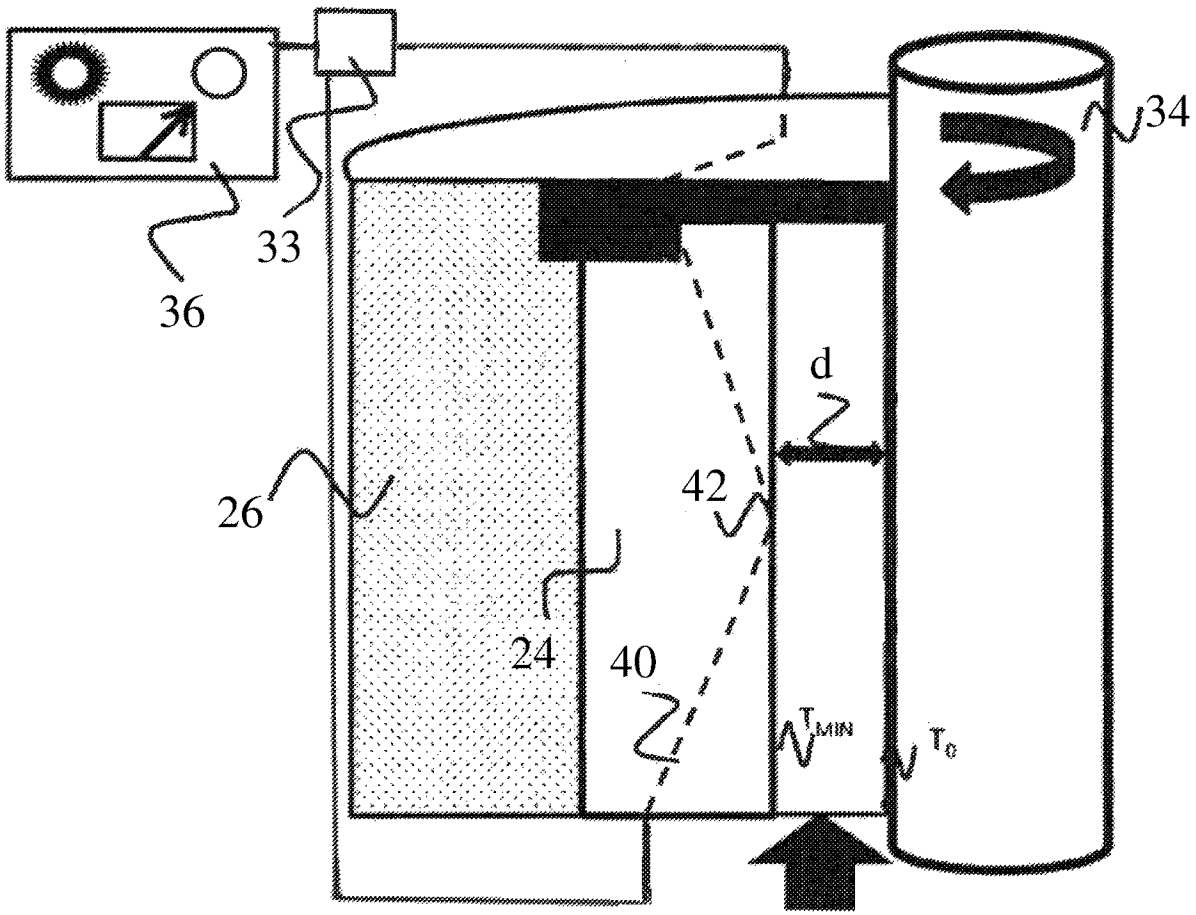
FIG. 14 illustrates a cutaway cross-section through a sealing assembly accordance with a further embodiment of the invention with the seal in a new, unworn, state.
Figure 15:
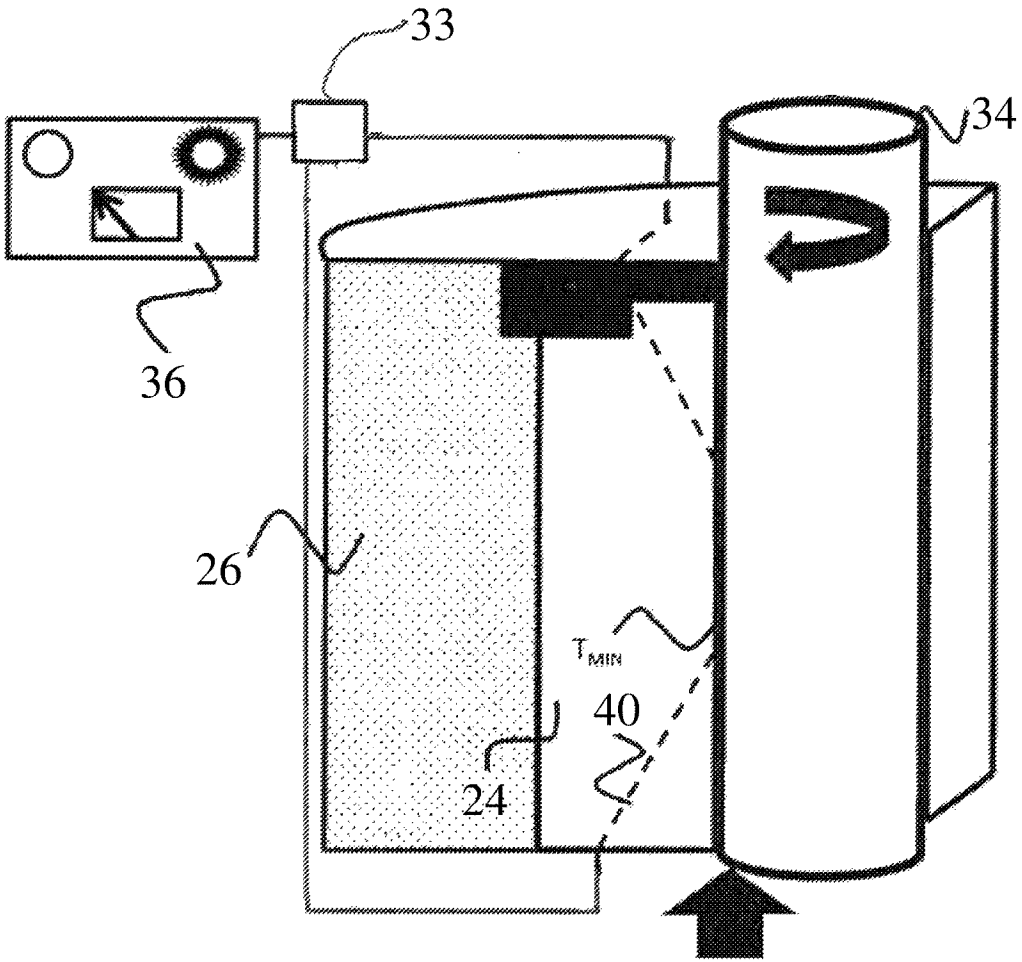
FIG. 15 illustrates the sealing assembly shown in FIG. 14 with the seal in a worn state, and requiring replacement.

This open circuit or "break circuit" method can equally be applied to a single or network of probes within the sealing element, where damage to a probe or plurality of probes connected to the circuitry also results in breaking of the circuit, and loss of voltage to signify the seal sleeve requires replacement. Where multiple break circuits are provided, these may be arranged to originate and terminate at a remote switch 33 (a signal input/output device), which sends a signal to an HMI 36 when one of the circuits is broken. This type of arrangement is illustrated in FIGS. 14 and 15.

The low voltage supply 30 required to generate the power for the embodiments described above may be supplied by a compact robust battery pack secured within the upper annular support plate of the seal sleeve 18. For example, a power supply of 4 to 20 milliamps or 10 volt maximum to operate the proximity sensor illustrated in FIGS. 8*a* and 8*b* may be supplied by a compact robust long life lithium ion battery pack solution, typical of what is used in downhole drilling tools but at a much smaller power supply scale. These are well known in the art.

The output circuit 32 may also be secured within the upper annular support plate with the battery pack.

Alternatively, low voltage may be supplied through an umbilical connection for the PCD 10 via a regulator, which contains a power supply and two way data transmission cables. In this case, when in operation, voltage or milliamp data may be continuously transmitted to a central control and processing unit through the cable and relayed to the control display 36.

Alternatively, a radio frequency indication device (RFID) may be used to facilitate wireless transmission to surface when the output circuit 32 closes, and continually pinging a signal to a receiver at surface to indicate $T_{MIN}$ has been reached and the output circuit 32 is closed. The transmitter may be located within the upper annular support plate of the seal sleeve 18.

Figure 16:
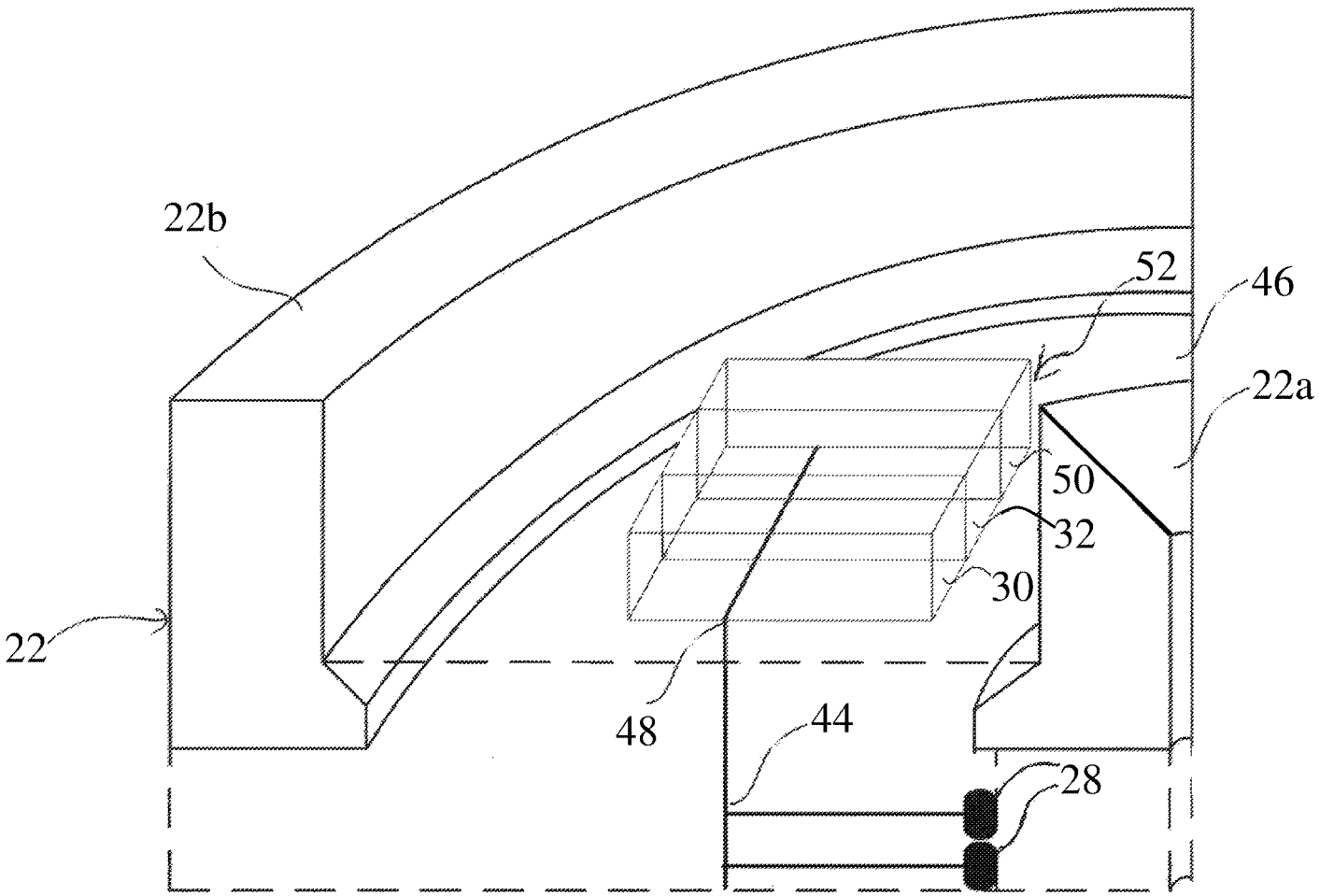
FIG. 16 illustrates a cutaway cross section of the seal sleeve top annular flange with the module containing the power supply, proximity switch, and transmitter, and illustrating its orientation within the flange connection and its connection to the probe network.

FIG. 16 shows a simplified cutaway cross section illustrating the upper annular support plate 22 of the seal sleeve reveals a proposed location of the low voltage power supply 30, output circuit 32, and (where used) the transmitter module. The support plate 22 has inner 22*a* and outer 22*b* longitudinally extending flanges.

As mentioned above, where a network of probes 28 is used, the probes 28 in the network are connected in series with a channeled wire or cable 44 co-moulded into the elastomeric part 26 of the seal 18*a*/18*b*. The channel may contain the wire 44 within a flexible silicon resin coating for protection. The wire 44 extends from the lower end of the seal 18*a*/18*b* to the top annular support plate 22, where it enters an inner passage profile 46 of the annular support plate 22. The passage profile 46 is contained between the outer flange 22*b* and the inner flange 22*a*.

Preferably an electrical stab or bayonet type connection 48 is supplied in the exposed surface of the passage profile 46 in which the elastomeric part 26 of the seal 18*a*/18*b* forms the base 30. The connection 48 is co-moulded within the elastomeric part 26 of the seal 18*a*/18*b* such that it extends to the base of the passage 46 to provide the electrical connection to the output circuit 32, power supply 30, and transmitter module 50. The resulting electrical connection 28 is intrinsically safe and waterproof.

The low voltage power supply 30, output circuit 32, and transmitter 33 are contained in a module 52, and this module 52 may be mounted and secured within the upper annular flange passage 46 of the sleeve 18. Preferably, the module 52 is immersed in a flexible silicon resin for water and vibration protection, well known in the art of downhole tools. However, other methods may be used such as a waterproof switch.

The output circuit 32 including the switching device and transmitter 33 are also part of this "resin module" 52 within the upper flange passage 46. These are connected in series within the module 52 in the following order—electrical connection 48 from sealing element to power supply (i.e., battery pack) 38, battery back 30 to output circuit 32, output circuit 32 to transmitter 50. An RFID is preferred, so that when the seal wear reaches its minimum safe operating thickness $T_{MIN}$ and the drill pipe contacts one or more embedded probe 28, the circuit 32 closes and the RFID pings a central control and processing module at surface.

It should be appreciated that the transmitter 50, output circuit 32, and power supply 30 may be in separate modules located and secured within the passage 46, and connected electrically in series.

Figure 17:
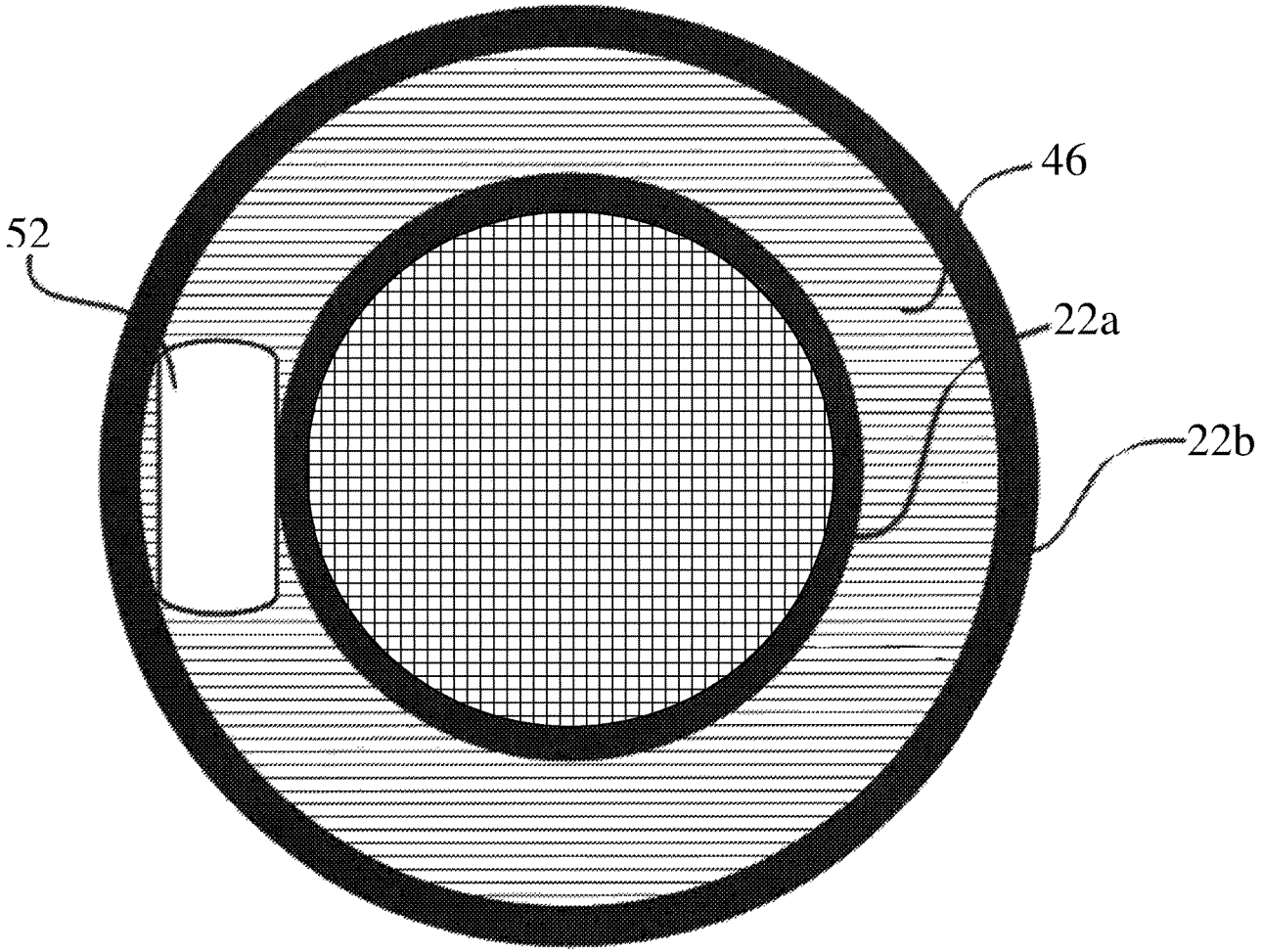
FIG. 17 illustrates a plan view of the seal sleeve top annular flange with the module containing the power supply, proximity switch, and transmitter, and illustrating its orientation within the flange connection.

Referring to FIG. 17, a plan view illustrating the upper annular support plate of the seal sleeve 18 reveals a proposed orientation of the low voltage power supply, output circuit, and transmitter module 52. The module 52 is positioned and secured within the flange passage 46 located between the outer 22*b* and inner 22*a* flange walls. The module 52 may be immersed in a flexible silicon resin for fluid and vibration protection during drilling.

It is appreciated the resin may fill the entire passage 46 which contains the module 52.

It is appreciated the module 52 may produce a larger footprint within the passage 46, and may include a dimensional profile which occupies the entire passage 46. Thus, the dimensional characteristics of the module 52 may increase but must be contained and protected within the passage profile 46.

It should be appreciated that, in the embodiments of the present invention described above, the voltage or current may be a continuous or intermittent (i.e., a pulse) supplied to the electrical input of the inventive system.

The present invention may use, but is not limited to, an audible alarm and a visual light of a specific colour to indicate when the seal sleeve needs to be replaced. The use of a digital or analogue readout continuously showing a numerical value for voltage present within the output circuit 30 presented on a computer monitor or Human-Machine-Interface (HMI) is preferred.

Through the HMI, a visual light of a different colour may be used to indicate that the output circuit 32 is open, representing conditions of an acceptable thickness remaining within the sealing element. For example, green may be present when the probe's magnetic field has not been interrupted, indicating a safe thickness remains. Orange may be used when the element has worn to $T_0$, and a red light may represent when the element has worn to $T_{MIN}$ and the seal sleeve 18 requires replacement.

It should be appreciated that the parameter measured and correlated to the degree of wear may not necessarily be a voltage or current, and could be any measuring parameter which links the degree of wear to a corresponding signal from the inventive system.

For example, other wear indication monitoring methods may be used, such as but not limited to, colored dyes, tracers, or other embedded particles co-moulded and confined within chambers or pockets in the matrix of the sealing element at $T_{MIN}$. These propagate into the returned drilling fluid once they are breached at $T_{MIN}$, and are detected at the rig shaker through continuous monitoring by mudloggers. Detection of any of these constituents signifies the seal sleeve needs to be replaced.

Further alternatively, a pressure channel or conduit may be embedded within the matrix of the sealing element for wear indication at $T_{MIN}$. The channel may connect to a micro pressure sensor or transmitter within the steel annular plate on the top of the seal sleeve. When thickness $T_{MIN}$ remains in the element, the channel is eroded and exposed to the wellbore to differential pressure and detected on the sensor. A signal is transmitted to surface signifying the seal sleeve requires replacement, and the wellbore pressure is still contained.

By virtue of the present invention, a preventative and proactive system and method may be provided where the wear of the or each seal is continuously and accurately monitored. The predetermined minimum safe operating thickness $T_{MIN}$ includes a safety factor that maximizes the operational life of the seal sleeve in service while not jeopardizing the rig safety. The safety factor built in to $T_{MIN}$ provides a sufficient element thickness to remain within the sleeve, preventing the total failure of the seal sleeve before it can be replaced. Through a visual or audible signal relayed to the RDD HMI at $T_{MIN}$ a level of safety is now introduced into the RDD operation. When the visual light and audible alarms trigger at $T_{MIN}$, a competent decision is made to replace the seal sleeve due to the certainty in its remaining thickness.

All embodiments of the present invention are designed to be intrinsically safe to satisfy all safety standards and guidelines associated with hazardous or zoned areas, for example, for installation above a land based BOP, at the top of a riser, or anywhere within the close vicinity of well centre.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the present invention in diverse forms thereof.

The present invention is not limited to embodiments described herein; reference should be had to the appended claims.

What is claimed is:

1. A seal assembly for use in a pressure containment device for containing a fluid pressure in an annular space around a drill string whilst allowing the drill string to rotate in the pressure containment device, the seal assembly comprising:

a seal comprising and an inner surface and a tubular body; and a wear sensor embedded in the tubular body, the wear sensor being configured to emit an alert signal when the inner surface of the seal has been worn away by a preset amount, wherein, the wear sensor comprises an inductive proximity sensor which comprises a probe comprising an inductive coil, the inductive coil being embedded in the seal.

2. The seal assembly as recited in claim 1, wherein, the tubular body is configured to extend through the seal, the alert signal comprises a change in an electrical current or voltage, and the wear sensor comprises an electrical power supply comprising a first pole which is electrically connected to the seal and a second pole which is configured to be connected to the tubular body extending through the seal.

3. The seal assembly as recited in claim 1, further comprising:

a probe configured to be electrically conductive embedded in the seal, wherein, the alert signal comprises a change in an electrical current or voltage, and the wear sensor comprises an electrical power supply comprising a first pole which is electrically connected to the probe embedded in the seal, and a second pole which is configured to be connected to a tubular body extending through the seal.

4. The seal assembly as recited in claim 1, further comprising:

an electrical output circuit comprising a switching device, the switching device being configured to move from an open position, in which the switching device prevents a flow of electrical current around the electrical output circuit, to a closed position, in which the switching device permits the flow of the electrical current around the electrical output circuit, when the seal has been worn away by the preset amount.

5. The seal assembly as recited in claim 1, further comprising:

an electrical output circuit comprising a switching device, the switching device being configured to move from a closed position, in which the switching device allows a flow of electrical current around the output circuit, to an open position, in which the switching device prevents the flow of the electrical current around the output circuit, when the seal has been worn away by the preset amount.

6. The seal assembly as recited in claim 1, wherein, the seal assembly further comprises an electrical output circuit comprising a switching device, and the inductive proximity sensor is connected to the electrical output circuit.

7. The seal assembly as recited in claim 1, wherein the alert signal changes based on a further wear of the seal.

8. The seal assembly as recited in claim 7, further comprising:

a probe configured to be electrically conductive embedded in the seal, wherein, the seal further comprises an outer surface, the tubular body is configured to extend through the seal, the alert signal comprises a change in an electrical current or voltage, the wear sensor comprises an electrical power supply which comprises a first pole which is electrically connected to the probe embedded in the seal and a second pole which is configured to be connected to the tubular body extending through the seal, and the probe is further configured to be tapered so that a cross-sectional area of the probe increases from a first end to a second end, the first end of the probe being closest to the inner surface of the seal, and the second end of the probe being closest to the outer surface of the seal.

9. The seal assembly as recited in claim 7, wherein, the wear sensor comprises an inductive proximity sensor which comprises a probe comprising either an inductive coil which is embedded in the seal or a plurality of inductive coils each of which is embedded in the seal and each of which is configured to produce a magnetic field having a different size.

10. The seal assembly as recited in claim 1, wherein the alert signal comprises a pressure signal.

11. The seal assembly as recited in claim 1, wherein the alert signal comprises a chemical signal.

12. The seal assembly as recited in claim 1, wherein, the alert signal is configured to change with a degree of wear of the seal, and further comprising:

a control display configured to provide a first visual indication that the alert signal has been emitted; and a second visual indication when the alert signal has changed to indicate that the seal has been worn away by a second preset amount.

13. The seal assembly as recited in claim 1, wherein the seal further comprises an outer surface, a non-elastomeric part, and an elastomeric part, the non-elastomeric part being configured to form the inner surface of the seal and being surrounded by the elastomeric part so that the elastomeric part forms the outer surface of the seal.

14. The seal assembly as recited in claim 13, wherein the wear sensor is located at a boundary between the non-elastomeric part and the elastomeric part.

15. A pressure containment device comprising the seal assembly as recited in claim 1.

16. The pressure containment device as recited in claim 15, further comprising:

a housing comprising a main passage arranged therein; and an actuator configured to urge the seal into a sealing engagement with a drill string extending through the pressure containment device.

17. The pressure containment device as recited in claim 16, wherein, the main passage comprises a longitudinal axis, and the actuator comprises a piston which is configured to be movable generally parallel to the longitudinal axis of the main passage of the housing.

18. The pressure containment device as recited in claim 17, wherein, the drill string extends along the main passage of the housing, and further comprising:

an annular packer comprising a central aperture in which the seal is mounted, the central actuator being configured to act on the annular packer so that the annular packer pushes the seal into an engagement with the drill string extending along the main passage of the housing.

19. A drilling system comprising:

a drill string; and a pressure containment device as recited in claim 1.

* * * * *